US005909005A

United States Patent [19]

Boston

[11] Patent Number: 5,909,005

[45] Date of Patent: Jun. 1, 1999

[54] COMBINATION BEARING PLATE AND ELECTRICAL GROUNDING APPARATUS

[75] Inventor: Harlan Earl Boston, West Point, Nebr.

[73] Assignee: Valmont Industries, Inc., Valley, Nebr.

[21] Appl. No.: 08/910,808

[22] Filed: Aug. 13, 1997

[51] Int. Cl.[6] ..... H01R 4/66

[52] U.S. Cl. ..... 174/6; 174/51; 248/539; 439/52

[58] Field of Search ..... 174/6, 40 R, 45 R, 174/40 CC, 51, 7, 38; 248/539, 519, 910; 439/92, 100

[56] References Cited

U.S. PATENT DOCUMENTS

| | | | |
|---|---|---|---|
| 2,303,861 | 12/1942 | Pennell | 174/6 |
| 2,455,641 | 12/1948 | Badeau et al. | 174/6 |
| 2,541,788 | 2/1951 | Stover | 200/16 R |
| 2,545,048 | 3/1951 | Salmons | 174/6 |
| 3,257,496 | 6/1966 | Hamilton | 174/38 |
| 3,300,570 | 1/1967 | Spiece et al. | 174/38 |
| 3,343,322 | 9/1967 | Lurkis et al. | 52/298 |
| 4,316,050 | 2/1982 | Bergmark | 174/7 |

*Primary Examiner*—Kristine Kincaid
*Assistant Examiner*—Dhiru R Patel
*Attorney, Agent, or Firm*—Zarley,McKee,Thomte, Voorhees & Sease; Dennis L. Thomte

[57] ABSTRACT

A bearing plate is formed of an electrically conductive material so as to act as an electrical grounding apparatus when mounted on the lower end of a utility pole. The bearing plate includes a generally circular base plate with a depending conical flange which will engage the ground. A pair of tabs are punched downwardly from the base plate so as to engage the ground and provide additional surface area for electrical grounding purposes. The bearing plate may be welded directly to the lower end of a hollow steel pole, or bolted to the bottom of a wood pole, or pole of other composition.

23 Claims, 3 Drawing Sheets

COMBINATION BEARING PLATE AND ELECTRICAL GROUNDING APPARATUS

TECHNICAL FIELD

The present invention relates generally to bearing plates and grounding rods for utility poles, and more particularly to an improved combination bearing plate and electrical grounding plate for utility poles.

BACKGROUND OF THE INVENTION

Conventional wood utility poles frequently require a grounding electrode to ground the neutral conductor of overhead power lines. The minimum code requirements for a wood pole grounding is four grounds per mile, and a ground at every equipment location. If the poles are constructed of steel, a ground rod is typically utilized for every pole.

The use of a ground rod to ground a utility pole suffers a number of drawbacks. First, when soil freezes, electrical resistance of the ground rod increases dramatically. In addition, ground rods are difficult to install and remove, and are virtually impossible to install in some soil conditions (such as rocky soil or hardpan).

Connection of the ground rod to the power line requires a clamp connecting a grounding wire from the pole to the rod, the clamp normally being installed one to two feet deep in the ground, in a high corrosion zone of the ground. The ground rod wire is typically attached to the pole above the ground line, where they can be easily cut or damaged.

Conventional steel poles are formed of galvanized steel in an elongated tubular configuration, the steel conventionally less than one-quarter inch thick. Because the National Electric Safety Code (NESC) requires any grounding device to be formed of material one-quarter inch thick or greater, the lower end of the pole itself cannot be used to electrically ground the pole. Thus, an additional grounding apparatus is necessary to electrically ground power lines supported by a steel utility pole.

Bearing plates for tubular steel utility poles are typically necessary to support the pole in the ground. The open tubular end of the pole does not provide a sufficient bearing surface to support the pole. Conventional bearing plates are rectangular in configuration, and attached to the bottom of the pole to provide the required bearing surface for the pole. However, because the conventional rectangular bearing plate projects beyond the diameter of the pole, the pole is not easily turned once positioned in a hole, nor is the pole easy to remove from the ground, once installed.

SUMMARY OF THE INVENTION

It is therefore a general object of the present invention to provide an improved combination bearing plate and electrical grounding plate for a utility pole.

Another object is to provide a grounded bearing plate which is simply and easily installed with a utility pole.

A further object of the present invention is to provide a grounded bearing plate which may be attached to either wood or steel utility poles.

Still another object is to provide a rounded bearing plate which provides required electrical grounding for a utility pole, and also provides the necessary bearing surface for a utility pole.

These and other objects of the present invention will be apparent to those skilled in the art.

The bearing plate of the present invention is formed of an electrically conductive material so as to act as an electrical grounding apparatus when mounted on the lower end of a utility pole. The bearing plate includes a generally circular base plate with a depending conical flange which will engage the ground. A pair of tabs are punched downwardly from the base plate so as to engage the ground and provide additional surface area for electrical grounding purposes. The bearing plate may be welded directly to the lower end of a hollow steel pole, or bolted to the bottom of a wood pole, or pole of other composition.

DESCRIPTION OF THE PREFERRED EMBODIMENT

Figure 1:
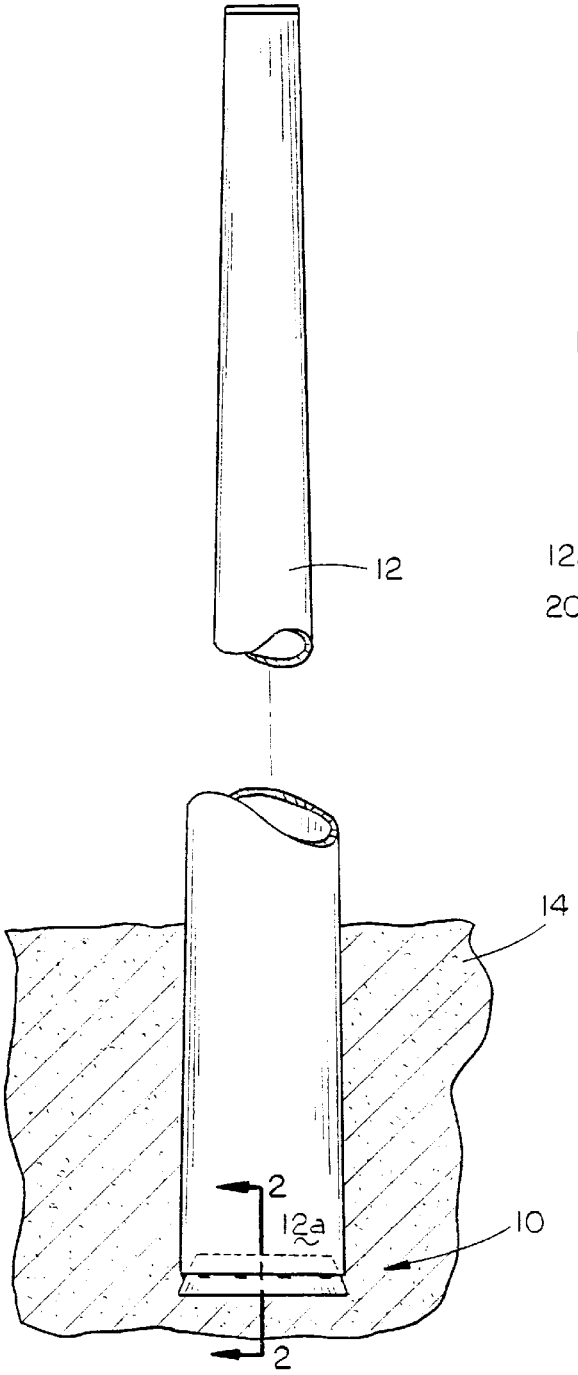
FIG. 1 is a side elevational view of a steel pole installed in the ground with the grounded bearing plate of the present invention.

Referring now to the drawings, in which similar or corresponding parts are identified with the same reference numeral and more particularly to FIG. 1, the combination bearing plate and electrical grounding plate of the present invention is designated generally at 10, and is shown affixed to the lower end 12*a* of a tubular steel utility pole 12 embedded in the ground 14. The upper end of pole 12 will support power lines or other structures (not shown).

Figure 4:
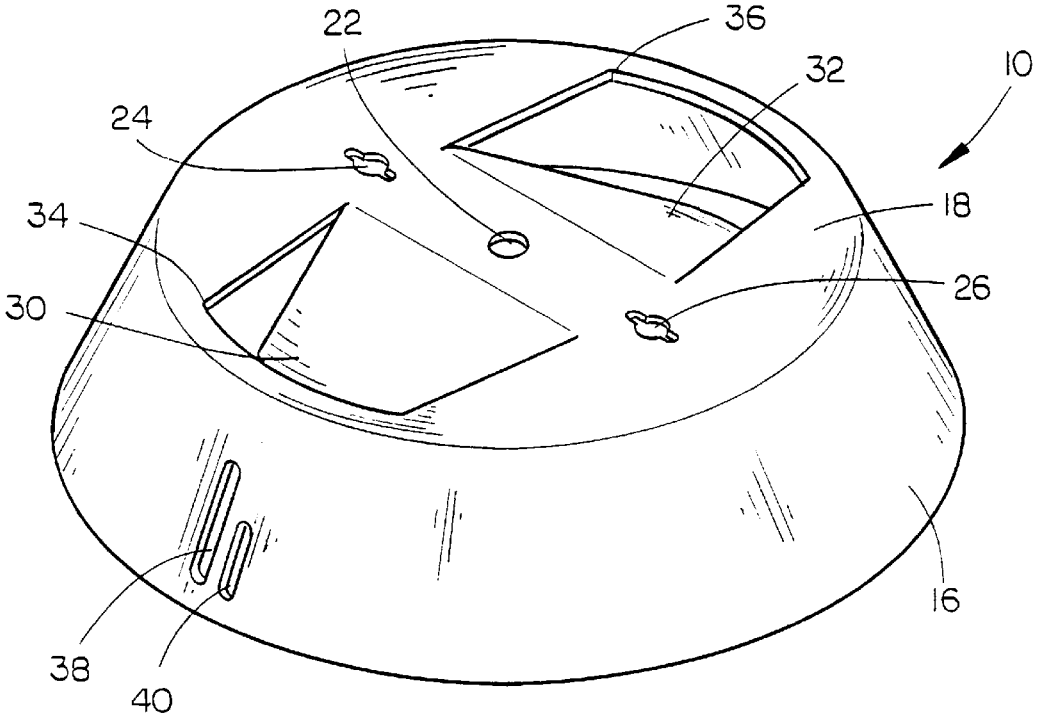
FIG. 4 is an enlarged perspective view of the grounded bearing plate of the present invention.
Figure 5:
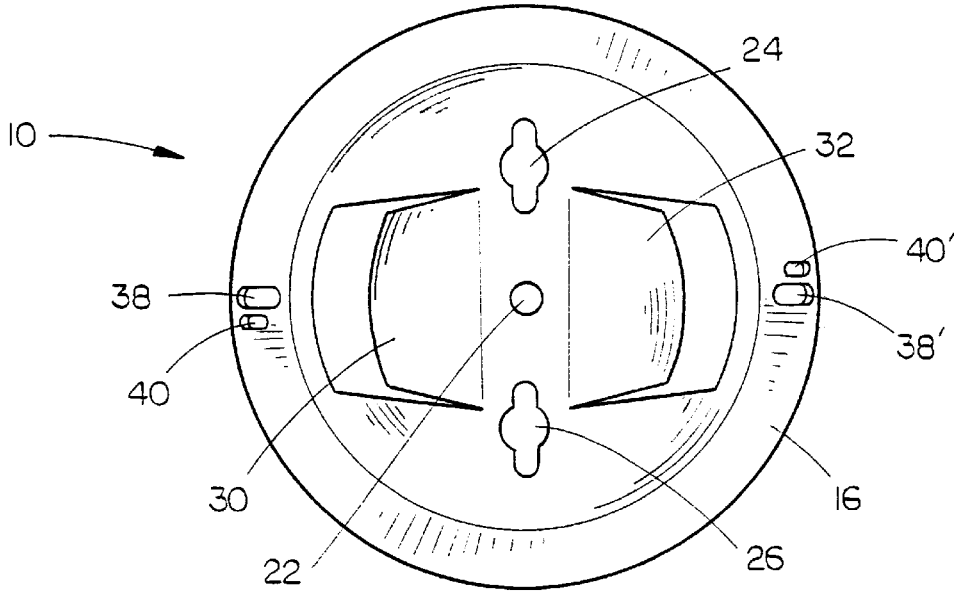
FIG. 5 is a top elevational view of the invention.
Figure 6:
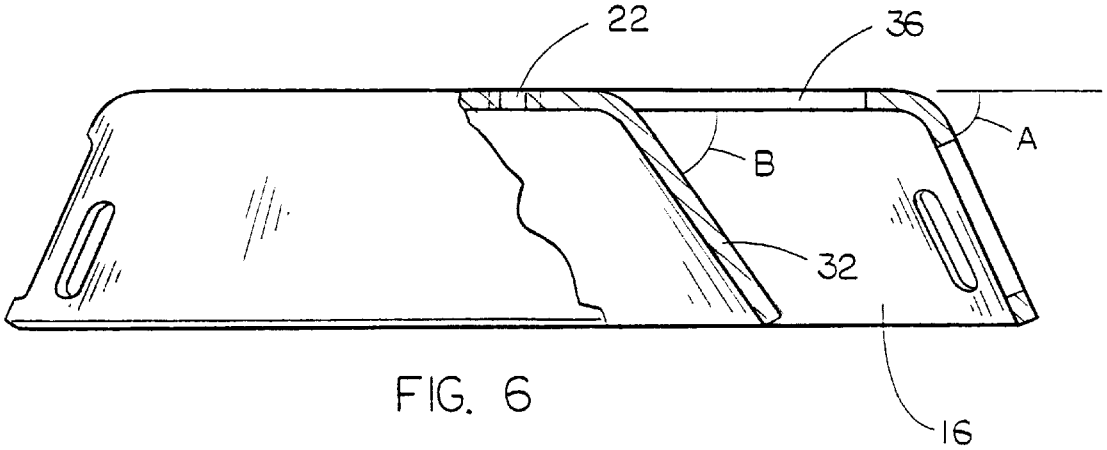
FIG. 6 is a side elevational view of the invention, with portions shown in section.

Referring now to FIGS. 4 and 5, bearing plate 10 is preferably formed from a flat disk shaped plate of electrically conductive material with a circumferential portion bent downwardly to form a conical flange 16 extending downwardly and outwardly from the circumference of a disk shaped generally flat base plate 18. As shown in FIG. 6, conical flange 16 is preferably disposed at an angle A of approximately 70° from horizontal.

Figure 2:
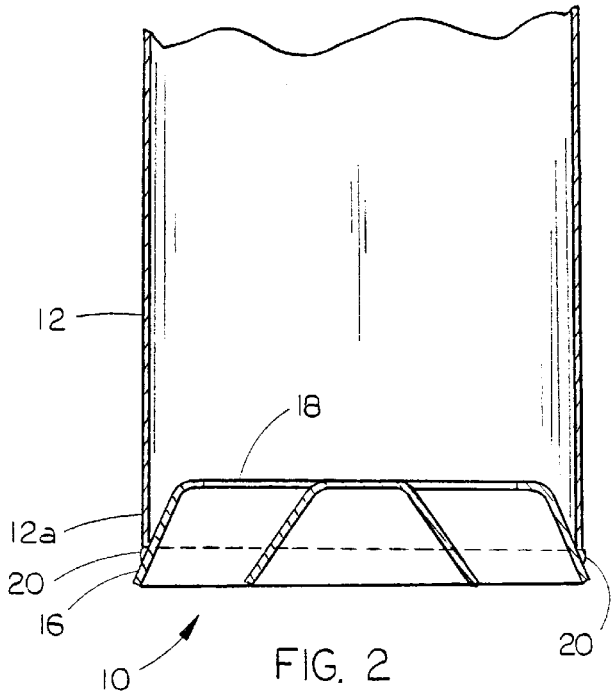
FIG. 2 is an enlarged sectional view taken at lines 2—2 in FIG. 1.
Figure 3:
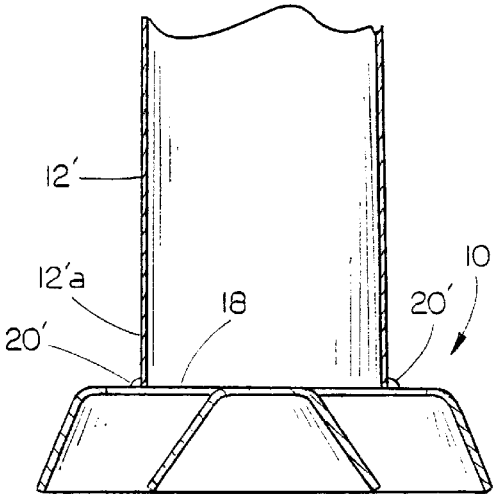
FIG. 3 is a sectional view similar to FIG. 2, with a steel pole of a different diameter installed thereon.

As shown in FIGS. 2 and 3, bearing plate 10 will support a wide range of diameters of poles 12. FIG. 2 shows a hollow tubular pole 12 having a diameter greater than the diameter of base plate 18, but less than the diameter of the lower end of conical flange 16. The lower end 12*a* of pole 12 is preferably affixed to flange 16 by weld 20, or the like.

FIG. 3 shows a pole 12' having a diameter which is less than the diameter of base plate 18 of bearing plate 10. In such a case, the lower end 12'*a* of pole 12' is affixed directly to base plate 18 by weld 20' or the like.

FIGS. 2 and 3 both show that the attachment of bearing plate 10 to a pole 12 or 12' will provide a bearing surface for the pole, yet is capable of easy removal (because of the conical flange 16), and permits easy rotation of the pole (and bearing plate 10) in the ground.

Figure 7:
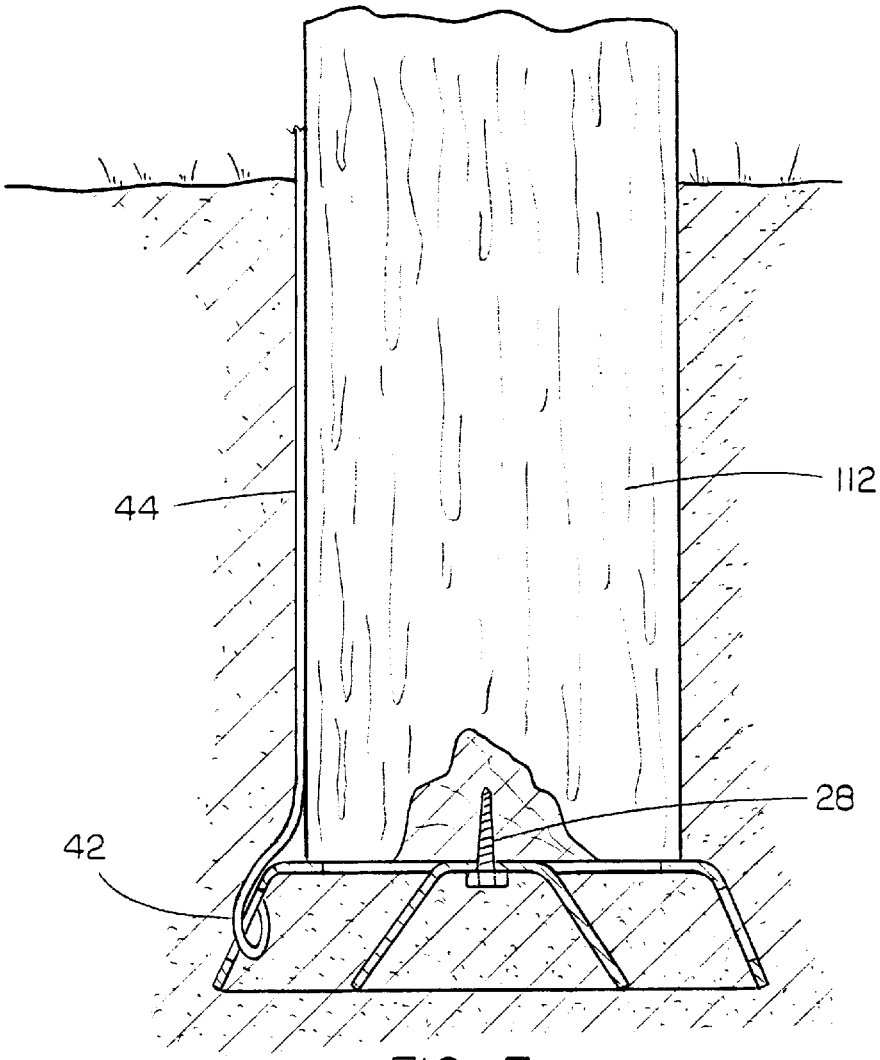
FIG. 7 is a side elevational view of the invention installed on a wood pole, with the bearing plate shown in section.

Referring once again to FIGS. 4–6, base plate 18 is provided with a central circular aperture 22, and a pair of keyhole apertures 24 and 26 positioned on opposite sides of central aperture 22. Apertures 22, 24 and 26 may be utilized to attach bearing plate 10 to a solid pole 112, as shown in FIG. 7, using a fastener 28.

In order to provide greater surface area for electrical grounding, a pair of tabs 30 and 32 are formed in base plate 18 and bent downwardly, as shown in FIGS. 4–6. Tabs 30 and 32 are of sufficient size to meet and exceed NESC and NEC requirements for soil contact area. To assist in the ease of manufacturing of bearing plates 10, tabs 30 and 32 are preferably formed by forming a pair of U-shaped cuts 34 and 36 in base plate 18, and then bending tabs 30 and 32 downwardly at an angle B of approximately 60° (see FIG. 6).

A pair of vertically extending slots 38 and 40 are formed through conical flange 16, with slot 38 preferably longer than slot 40. A second pair of vertical slots 38' and 40' are formed in conical flange 16 diametric to slots 38 and 40. Slots 38 and 40 and 38' and 40' are designed to receive the conventional J-hook 42 of a ground wire 44 as shown in FIG. 7.

As noted above, the bearing plate 10 of the present invention has many operational as well as installation advantages over prior art grounding rods. The current practice for grounding a utility pole calls for the digging of a trench two feet from the pole and two feet deep. A ground rod approximately eight feet long is driven into the ground within the trench. A ground clamp is attached to the ground rod and a ground wire is then run up the pole to connect the neutral conductor of the power lines. The trench is then filled and tamped to complete the grounding process.

With the bearing plate 10 of the present invention, the pole is immediately grounded when it is set into the ground.

Because the bearing plate 10 is located at the lower end of the pole, far below the ground surface, the soil around the bearing plate 10 is not subject to the freezing conditions or the corrosion which occur in the first one to two feet of top soil. Use of bearing plate 10 on a hollow steel pole is especially beneficial, since the bearing plate 10 is preferably formed of one-quarter inch thick galvanized steel, such that there is no dissimilar metal next to the steel pole.

As noted above, bearing plate 10 may also be utilized with solid poles, and with poles of electrically non-conductive material. Openings and fasteners are provided to attach the bearing plate to the bottoms of solid poles, and a conventional ground wire may be attached through the pair of slots 38 and 40, or 38' and 40', in a conventional fashion.

Finally, the conical shape of the flange, and the flat bent tabs, permits bearing plates 10 to be stored and/or shipped nested together in a stack, thereby saving on storage and shipping costs.

Whereas the invention has been shown and described in connection with the preferred embodiment thereof, many modifications, substitutions and additions may be made which are within the intended broad scope of the appended claims.

I claim:

1. A bearing and grounding plate for placement in the ground, comprising:

a generally flat base plate having upper and lower surfaces and a circumferential edge;

a flange depending downwardly and outwardly from said base plate edge;

said base plate and said flange being comprised of an electrically conductive material; and means for electrically connecting said base plate to a metal pole.

2. The bearing and grounding plate of claim 1, wherein said base plate is generally circular.

3. The bearing and grounding plate of claim 2, wherein said flange extends continuously around the entire circumferential edge of the base plate.

4. The bearing and grounding plate of claim 3, wherein said flange is generally conical in shape.

5. The bearing and grounding plate of claim 4, wherein said flange depends from the base plate at an angle of approximately 70° from horizontal.

6. A bearing plate, comprising:

a generally flat base plate having upper and lower surfaces and a circumferential edge;

a flange depending downwardly and outwardly from said base plate edge;

means for connecting said flange to a pole; and a tab depending from said base plate downwardly from said upper surface inwardly of said flange.

7. The bearing plate of claim 6, further comprising a second tab depending from said base plate downwardly from said upper surface and inwardly of the flange, the second tab spaced from the first tab, the tabs generally diametric to a center of the base plate.

8. The bearing plate of claim 7, wherein said tabs are formed of portions of the base plate bent downwardly.

9. The bearing plate of claim 8, wherein said base plate, tabs, and flange are formed from a single integral piece of electrically conductive material.

10. The bearing plate of claim 9, wherein the electrically conductive material is galvanized steel.

11. In combination:

a hollow pole of electrically conductive material, having a lower end embedded in the ground;

a bearing plate of electrically conductive material, mounted on the lower end of the pole and electrically connected thereto;

said bearing plate including a depending flange extending downwardly and outwardly into the ground, said flange formed of electrically conductive material and having a predetermined surface area in contact with the ground for electrically grounding the pole.

12. The combination of claim 11, wherein said bearing plate includes a flat base plate with a circumferential edge, and wherein said flange depends downwardly and outwardly from the edge.

13. The combination of claim 11, wherein said base plate is generally circular.

14. The combination of claim 12, wherein said flange extends continuously around the entire circumferential edge of the base plate.

15. The combination of claim 13, wherein said flange is generally conical in shape.

16. In combination:

a hollow pole of electrically conductive material, having a lower end embedded in the ground; a bearing plate of electrically conductive material, mounted on the lower end of the pole and electrically connected thereto; said bearing plate including a depending flange extending downwardly and outwardly into the ground, said flange formed of electrically conductive material and having a predetermined surface area in contact with the ground for electrically grounding the pole; said bearing plate including a generally flat base plate having upper and lower surfaces and a circumferential edge;

said flange depending downwardly and outwardly from said circumferential edge; and a tab depending from said base plate downwardly from said upper surface inwardly of said flange.

17. The combination of claim 16, further comprising a second tab depending from said base plate downwardly from said upper surface and inwardly of the flange, the second tab spaced from the first tab, the tabs generally diametric to a center of the base plate.

18. The combination of claim 17, wherein said tabs are formed of portions of the base plate bent downwardly.

19. In combination:

a pole of electrically non-conductive material having an upper end supporting at least one electrically conductive line, and a lower end embedded in the ground;

a bearing and grounding plate of electrically conductive material mounted on the lower end of the pole; and an electrically conductive ground wire electrically connected between said bearing and grounding plate and said at least one line to ground the line.

20. The combination of claim 19, wherein said bearing and grounding plate includes a generally flat base plate having upper and lower surfaces and a circumferential edge, and a flange depending from the base plate edge.

21. The combination of claim 20, wherein said base plate is generally circular, and wherein said flange extends continuously around the entire circumferential edge of the base plate.

22. The combination of claim 21, wherein said flange is generally conical in shape.

23. The combination of claim 20, further comprising a tab depending from said base plate downwardly from said upper surface and inwardly of the flange.

* * * * *